US005790156A

United States Patent [19]

Mutton et al.

[11] Patent Number: 5,790,156

[45] Date of Patent: Aug. 4, 1998

[54] FERROELECTRIC RELAXOR ACTUATOR FOR AN INK-JET PRINT HEAD

[75] Inventors: Jon C. Mutton, Portland; Hue P. Le, Beaverton, both of Oreg.; Qiming Zhang, State College, Pa.; Ronald L. Adams, Newberg, Oreg.; L. Eric Cross, State College; Thomas R. Shrout, Port Matilda, both of Pa.; Qiyue Chia Jiang, Wilsonville, Oreg.

[73] Assignee: Tektronix, Inc., Wilsonville, Oreg.

[21] Appl. No.: 844,915

[22] Filed: Apr. 22, 1997

Related U.S. Application Data

[63] Continuation of Ser. No. 315,361, Sep. 29, 1994, abandoned.

[51] Int. Cl.[6] ..... B41J 2/045

[52] U.S. Cl. ..... 347/71; 310/331; 310/358

[58] Field of Search ..... 347/70, 68, 71; 252/62.9 PZ; 501/136, 134; 310/328, 330, 358, 366, 365; 427/100

[56] References Cited

U.S. PATENT DOCUMENTS

| | | | |
|---|---|---|---|
| 4,265,668 | 5/1981 | Fujiwara et al. | 106/73.3 |
| 4,716,134 | 12/1987 | Yamaguchi et al. | 501/136 |
| 5,028,812 | 7/1991 | Bartky | 347/12 |
| 5,087,930 | 2/1992 | Roy et al. | 346/140 R |
| 5,210,455 | 5/1993 | Takeuchi et al. | 310/328 |
| 5,212,497 | 5/1993 | Stanley et al. | 347/19 |
| 5,345,139 | 9/1994 | Gururaja et al. | 310/358 |

FOREIGN PATENT DOCUMENTS

| | | | |
|---|---|---|---|
| 4513786 | 5/1970 | Japan | 501/136 |
| WO9005202 | 5/1990 | WIPO . | |

*Primary Examiner*—Benjamin R. Fuller
*Assistant Examiner*—Charlene Dickens
*Attorney, Agent, or Firm*—Ralph D'Alessandro; Richard B. Preiss

[57] ABSTRACT

A ferroelectric relaxor ceramic actuator material, such as lead magnesium niobate ("PMN"), has high electromechanical conversion efficiency, exhibits wide operating and manufacturing temperature ranges, does not require permanent polarization, and provides useful mechanical activity with reduced electrical drive voltages. A PMN actuator (66) may be bonded to an actuator diaphragm (64) with a high temperature soldering or brazing process. PMN material also has a diffuse Curie point range in which the dielectric constant (40), "d" coefficient (32), and dielectric loss (42) characteristics all rise to a peak and then fall as the temperature increases. A phase-change ink-jet print head (50) employs a PMN actuator that is compounded with lead titanate ("PT") to increase the temperature ($T_M$) at which the peak dielectric constant occurs. The print head is operated at a temperature beyond the peak where the PMN:PT actuator "d" coefficient decreases as the temperature increases such that an increase in ink-jet drop ejection velocity caused by reduced ink viscosity is compensated for by a corresponding reduction in mechanical activity. The PMN:PT actuator thereby relaxes the temperature regulation and heat spreading requirements of the phase-change ink-jet print head.

9 Claims, 7 Drawing Sheets

FERROELECTRIC RELAXOR ACTUATOR FOR AN INK-JET PRINT HEAD

This is a continuation of application Ser. No. 08/315,361 filed Sep. 29, 1994 which is now abandoned.

TECHNICAL FIELD

This invention relates to ink-jet print head actuators and more particularly to making and using ferroelectric relaxor electrostrictive ceramic actuators in drop-on-demand ink-jet printers.

BACKGROUND OF THE INVENTION

Ink-jet systems, and in particular drop-on-demand ink-jet systems, are well known in the art. The principle behind an impulse ink-jet is the displacement of an ink chamber and subsequent emission of ink droplets from the ink chamber through a nozzle. A driver mechanism is used to displace the ink in the ink chamber. The driver mechanism typically consists of an actuator, often referred to as a transducer, such as a piezoelectric material bonded to a thin diaphragm. When a voltage is applied to the actuator, it attempts to change its planar dimensions, but, because it is securely and rigidly attached to the diaphragm, bending occurs. This bending displaces ink in the ink chamber, causing the flow of ink both through an inlet from the ink supply to the ink chamber and through an outlet and passageway to a nozzle. In general, it is desirable to employ a geometry that permits multiple nozzles to be positioned in a densely packed array. However, the arrangement of ink chambers and coupling of ink chambers to associated nozzles is not a straightforward task, especially when compact ink-jet array print heads are sought. The relatively large size of the actuator required to effectively expel ink drops is a major problem limiting the packing density of ink-jet array print heads.

There are previously known apparatus and methods for increasing the packing density of ink-jet arrays employing electrostrictive materials as actuators. In particular, U.S. Pat. No. 5,087,930 issued Feb. 11, 1992 for DROP-ON-DEMAND INK JET PRINT HEAD, which is assigned to the assignee of this application and incorporated herein by reference, describes an extremely compact ink-jet print head having an array of closely spaced nozzles that are supplied from densely packed ink pressure chambers by way of offset channels. The ink supply inlets leading to the pressure chambers and the offset channels are designed to provide uniform operating characteristics to the ink-jet nozzles of the array. To enhance the packing density of the pressure chambers, the ink supply channels leading to the pressure chambers and offset channels are positioned in planes between the pressure chambers and nozzles. The ink-jet print head is assembled from plural plates with features in all except a nozzle-defining plate being formed by photo-patterning and etching processes without requiring machining or other metal working.

The pressure chambers are driven by ink-jet actuators employing a piezoelectric ceramic, such as lead zirconium titanate ("PZT"). A predetermined amount of mechanical displacement is required from the PZT actuator to displace ink from the pressure chamber and out the nozzles. The displacement is a function of several factors, including PZT actuator size, shape and mechanical activity level, diaphragm size, material, and thickness, and the boundary conditions of the bond between the actuator and the diaphragm.

PZT is permanently polarized to enable mechanical activity, which is dependent upon the level of polarization as well as material properties. To polarize PZT, an electric field is applied such that domains in the PZT are oriented to align with the electric field. The amount of polarization as a function of electric field strength is nonlinear and has a saturation level. When the polarizing electric field is removed, the PZT domains remain aligned resulting in a net polarization referred to as a remnant polarization. Alignment of the PZT domains causes a dimensional change in the material. Subsequent applications of an electric field causes a dimensional change that is linear with respect to applied electric field strength.

Unfortunately, PZT has a number of properties that can reduce its mechanical activity over time. For instance, applying an electric field in a direction opposite to the initial remnant polarization can cause a reduction in the amount of polarization. Likewise, cyclic variations of an applied electric field in the direction opposing the polarization can cumulatively and continuously degrade the polarization.

PZT has a property referred to as the Curie point, a temperature at which the remnant polarization in the material becomes zero. Because PZT material is not entirely uniform, there is a range of temperatures over which some but not all of the polarization is lost. The polarization loss is not instantaneous, thereby defining a time-temperature level that should not be exceeded.

Skilled workers know to avoid the above-described PZT material problems and use the material with efficacy within its allowable operational boundaries. One measure of the efficiency of PZT as an actuator is referred to as the piezoelectric "d" coefficient, which may be defined by the following mathematical expression.

$$d = \frac{\text{Charge Displaced (Coulombs)}}{\text{Stress (Newtons)}} = \frac{\text{Strain (Meters)}}{\text{Field Strength (Volts)}}$$

PZT actuators have various shapes, including disks and rectangular blocks. Polarization ensures that the PZT materials are anisotropic such that several "d" coefficients may be defined for each shape, in which each "d" coefficient relates a particular dimensional change to a particular direction of the polarization and applied field. For a typical disk-shaped actuator, a commonly employed "d" coefficient is the "d_" coefficient, which is a measure of the strain perpendicular to the direction of polarization when the electric field is applied in the direction of polarization. The strain is evident as a radial contraction in the actuator because $d_{31}$ is negative.

A high $d_{31}$ value is indicative of high mechanical activity and is desirable for making efficient ink-jet arrays having a high packing density. Stability of the $d_{31}$ value is necessary to maintain constant ink-jet performance over an extended time period.

FIG. 1A shows a prior art ink-jet actuator structure 10, referred to as a unimorph, in which a disk 12 of PZT material is bonded to a flexible metal diaphragm 14. A direction of polarization is in the same direction as the applied electric field as indicated by an arrow 16. As shown in FIG. 1B, when an electrical voltage source 18 is applied through a switching device 20 to a metalized surface 22, an electric field is established across disk 12 in direction 16 that causes a radial diameter 24 of disk 12 to attempt to decrease. However, because a lower surface of disk 12 is bonded to metal diaphragm 14, disk 12 and metal diaphragm 14 bend downwardly to assume a convex shape.

Applying an opposite polarity electrical voltage to metalized surface 22 causes radial diameter 24 to attempt to increase such that disk 12 and metal diaphragm 14 assume a concave shape.

Maintaining PZT actuator 10 polarization during print head manufacturing is difficult for the following reasons. If disk 12 is bonded to diaphragm 14 before disk 12 is polarized, a significant permanent strain is introduced when disk 12 is polarized. The permanent strain may be sufficiently large to crack disk 12, destroying actuator structure 10. Therefore, disk 12 must be polarized prior to bonding, which, because of the above-described Curie point problem, severely limits the time and temperature allowable during bonding, thereby limiting the bonding to materials such as organic adhesives. Such adhesives degrade with time at elevated temperatures.

Because phase-change ink-jet printing requires elevated temperatures to melt solid ink for ejection from the print head. Phase-change ink-jet performance could, therefore, change over time as the adhesive degrades.

The electric field strength must also be limited to maintain the PZT material "d" coefficient over an extended time period. Unfortunately, limiting the electric field strength limits the amount of mechanical activity available from actuator 10.

The allowable electric field strength is also a function of temperature such that operation at elevated temperatures, as when phase-change inks are employed, further limits the allowable electrical field strength.

Even with all the above-described electric field strength limitations, PZT actuators still require about 60 volts to achieve a useful maximum electric field strength. Conventional integrated circuits cannot typically handle such voltages.

Because the viscosity of phase-change ink decreases as temperature increases, ink drop ejection velocity changes accordingly. Therefore, phase-change ink-jet print heads have typically required very uniform temperature regulation and heat spreading to ensure uniform drop ejection velocity across an entire array of nozzles.

What is needed, therefore, is a more efficient actuator material that enables making ink-jet print heads having a higher packing density and a longer operational life. An ideal actuator material would require no polarization before bonding and would withstand a wider temperature range, thereby allowing a wider range of manufacturing techniques to be employed. The ideal actuator material should also exhibit desirable operational temperature characteristics and require a lower electric field strength for operation.

SUMMARY OF THE INVENTION

An object of this invention is, therefore, to provide a more efficient and higher density ink-jet print head apparatus and a method for making same.

Another object of this invention is to provide an improved ink-jet actuator material and a method for making same.

A further object of this invention is to provide an apparatus and a method for relaxing the temperature control requirements of phase-change ink-jet printing.

Still another object of this invention is to provide an apparatus and a method for improving the drop ejection velocity uniformity of an array-type phase-change ink-jet print head.

Accordingly, this invention employs ferroelectric relaxor ceramic actuator materials, such as lead magnesium niobate ("PMN") or lead lanthanum zirconium titanate (PLZT) in ink-jet actuators. The PMN actuator material has high efficiency, exhibits wide operating and manufacturing temperature ranges, does not require permanent polarization, and provides useful mechanical activity with reduced electrical drive voltages. PMN material may be bonded to actuator diaphragms with high temperature soldering or brazing processes that are more stable than organic adhesives. PMN also has a diffuse Curie point range in which the dielectric constant, "d" coefficients, and dielectric loss characteristics all rise to a peak and then fall as the temperature increases. A phase-change ink-jet print head employs a PMN actuator that is compounded with lead titanate ("PT") to increase the temperature at which the peak occurs. The print head is operated at a temperature beyond the peak where the PMN:PT actuator "d" coefficient decreases as the temperature increases such that an increase in ink-jet drop ejection velocity caused by reduced ink viscosity is compensated for by a corresponding reduction in mechanical activity. The PMN:PT actuator thereby relaxes the temperature regulation and heat spreading requirements of the phase-change ink-jet print head.

Additional objects and advantages of this invention will be apparent from the following detailed description of a preferred embodiment thereof that proceeds with reference to the accompanying drawings.

DETAILED DESCRIPTION OF PREFERRED EMBODIMENT

PMN-based materials are described in U.S. Pat. No. 4,716,134 issued Dec. 29, 1987 for DIELECTRIC CERAMIC COMPOSITION and U.S. Pat. No. 4,265,668 issued May 5, 1981 for HIGH DIELECTRIC CONSTANT TYPE CERAMIC COMPOSITION. Such PMN materials are useful as miniature ceramic capacitor dielectrics because of their high dielectric constant that can be adjusted to a peak value at room temperature by the addition, during manufacturing, of a doping compound.

PMN-based materials have also been studied for use in sonar hydrophone applications. However, until now, their use as ink-jet actuators has been unknown.

In particular, PMN materials belong to a class of ferroelectric relaxor ceramic materials that are electrostrictive, that is, the material strains when an electric field is applied. Electrostrictive materials are polarized by the applied field and exhibit very little permanent polarization. The amount of polarization is approximately linearly related to the applied electric field strength. The strain is linearly related to the applied electric field strength and to the amount of polarization.

Figure 1A:
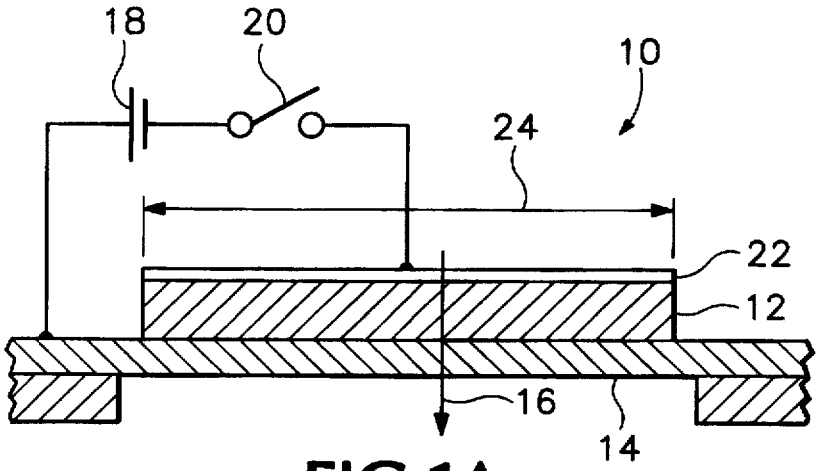
FIG.1A (PRIOR ART)
FIGS. 1A and 1B are enlarged cross-sectional pictorial diagrams of a prior art pressure chamber and PZT actuator shown respectively without and with an applied electric field.
Figure 1B:
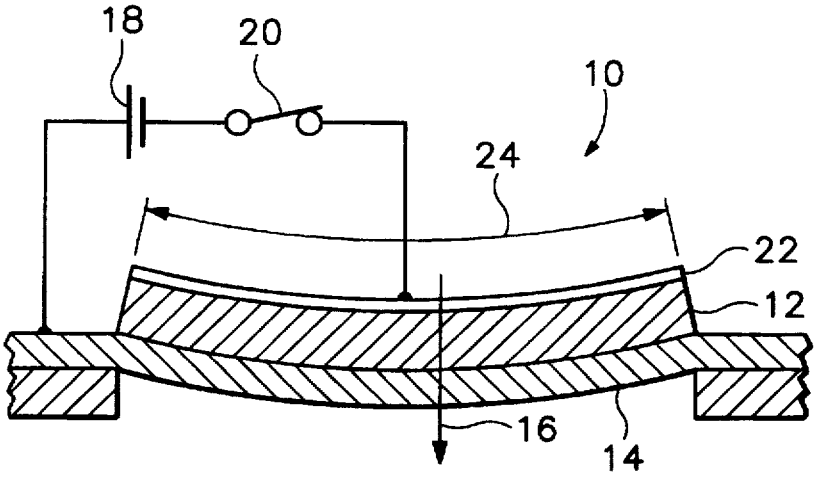
FIG.1B (PRIOR ART)
Figure 2:
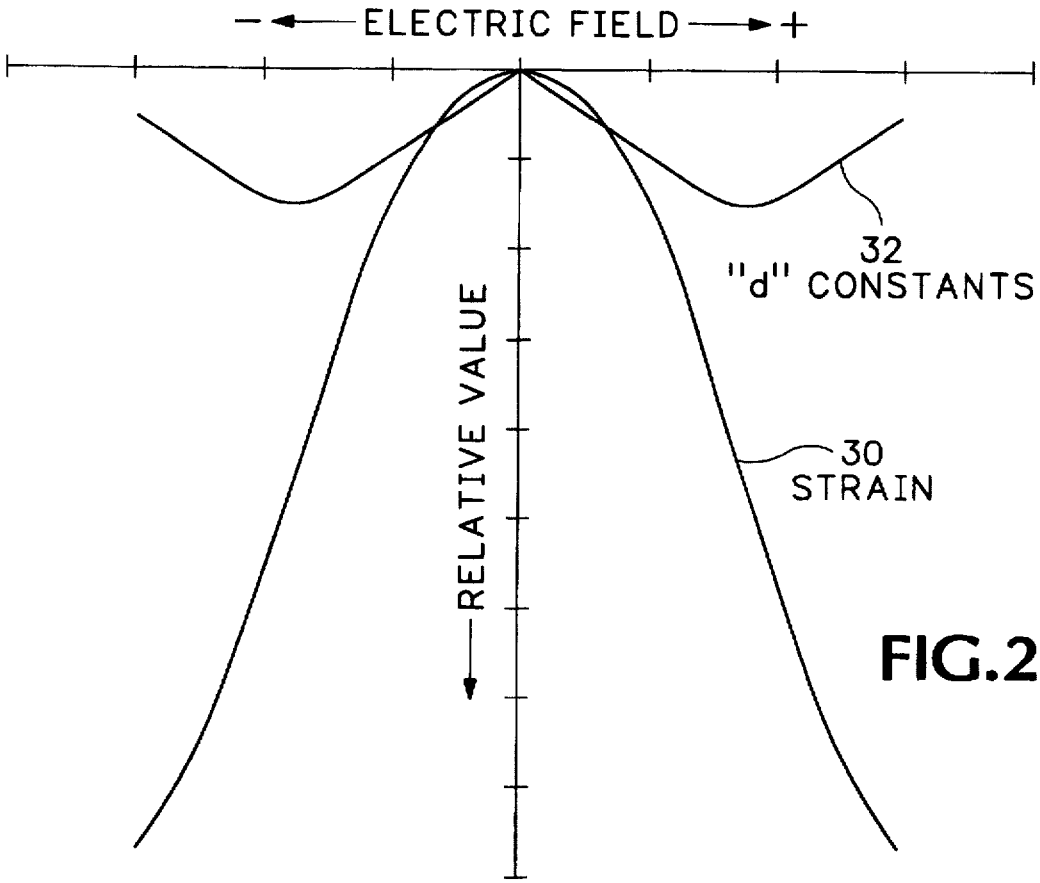
FIG. 2 is a graphical representation of strain versus electric field strength in a ferroelectric relaxor ceramic material.

As shown graphically in FIG. 2, a resultant strain 30 is a function of the square of the applied electric field strength. That is, doubling the electric field strength doubles the polarization that interacts with the applied field, resulting in four times the strain. As the electric field strength increases, the absolute value of "d" coefficients 32 increase to a peak and then decrease as the polarization saturates.

Figure 3:
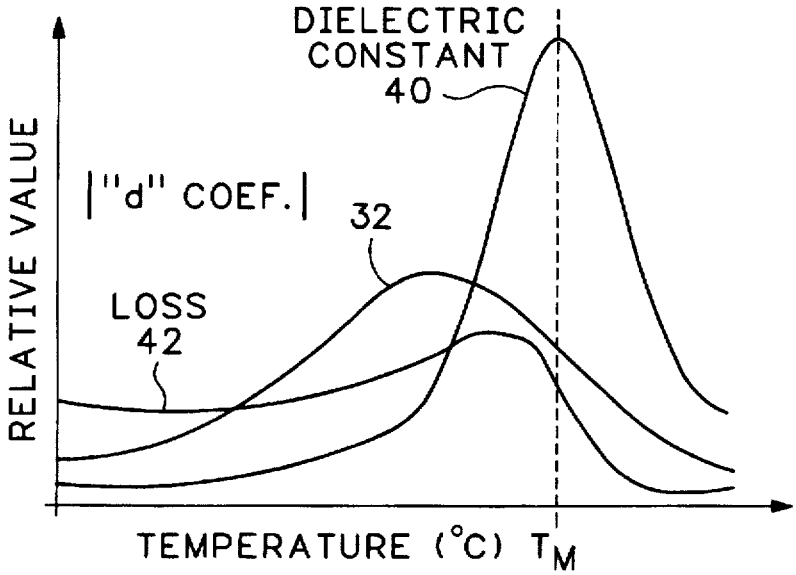
FIG. 3 is a graphical representation of dielectric loss, "d" coefficient, and dielectric constant versus temperature for a ferroelectric relaxor ceramic material.

As represented in FIG. 3, PMN materials have a diffuse Curie temperature range that causes the absolute value of "d" coefficients 32, dielectric constant 40, and dielectric loss 42 all to increase to a peak and then fall as a function of temperature. The temperature at which dielectric constant 40 is maximum is designated $T_M$. PMN materials may be compounded with various materials and dopants that change $T_M$ to a predetermined temperature. For example, adding 0.25 mole % PT changes $T_M$ from about −10° C. to about 125° C. The resulting PMN:PT material has beneficial properties that are described with reference to FIG. 6.

Because PMN materials are polarized by an applied electric field, they do not require permanent polarization prior to bonding to a diaphragm and may, therefore, be heated to high temperatures without degrading. The range of bonding techniques that may be employed is, therefore, expanded to include high-stability, high-temperature soldering or brazing.

Some PMN-type formulations exhibit higher mechanical activity than the best PZT materials, making possible physically smaller actuators and pressure chambers and/or lower actuator drive voltages for a given pressure chamber size. Associated benefits include increased ink-jet array packing density, reduced actuator driver electronics cost, and increased integrated driver functionality.

Regarding driver functionality, PMN-based materials allow drive voltage reductions from PZT driving levels of about plus and minus 60 volts to about plus and minus 18 volts or less. The die area required by associated integrated drive circuits can be proportionally reduced and/or used to support additional circuitry, such as linear amplifiers that can serve as actuator signal sensors. As signal sensors, each actuator can measure parameters such as temperature, pressure, resonance, and bubble presence for an associated pressure chamber.

An typical signal sensor circuit employs a PMN-based actuator as a variable capacitor in a first leg of a balanced capacitor bridge. A second leg of the bridge includes a balancing capacitor having about the same capacitance value as the actuator. Both legs further include terminating capacitors having about the same capacitance value as the balancing capacitor. The drive signal drives both legs of the bridge and a differential amplifier senses the difference voltage across the bridge terminating capacitors.

A market demand for higher printing resolutions creates the need for higher ink-jet array packing density. The smaller pressure chambers, ink channels, and associated features result in ink-jets having higher resonant frequencies, higher maximum droplet ejection repetition rates, and improved drop ejection velocity uniformity. Unfortunately, higher packing density increases the mechanical activity required from the correspondingly smaller pressure chambers, thereby limiting the possible drive voltage reduction. Skilled workers will recognize that different printing applications require compromises between packing density and actuator drive voltage, but all applications are markedly improved by the higher mechanical activity provided by PMN-based materials.

Figure 4:
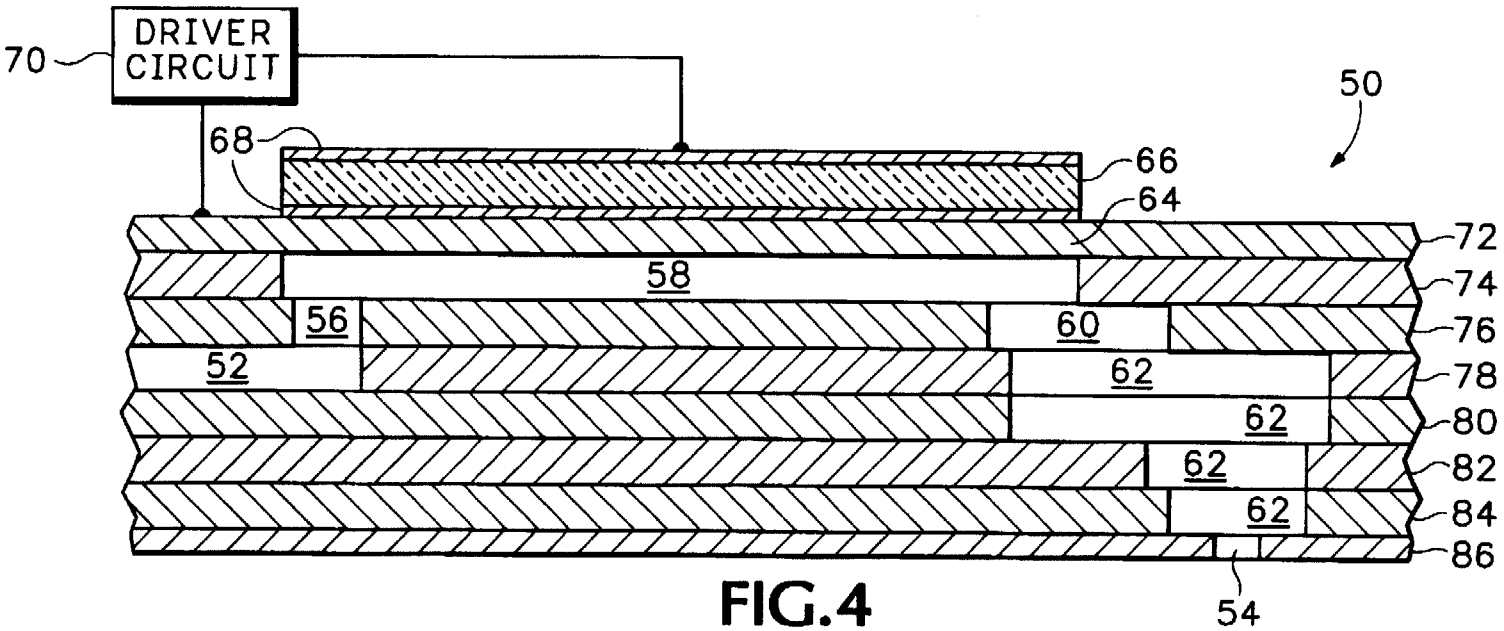
FIG. 4 is an enlarged fragmentary cross-sectional plan view showing an ink-jet print head employing an actuator of this invention.

A PMN actuator driven ink-jet print head may be a simple single jet print head or an ink-jet array type print head. Referring to FIG. 4, one channel of a multi-orifice ink-jet array print head 50 according to this invention is shown having an ink supply channel 52 through which ink is delivered to an ink drop forming nozzle 54.

Ink flows from an ink supply manifold (not shown), through ink supply channel 52, through an ink inlet 56, and into an ink pressure chamber 58. Ink leaves pressure chamber 58 by way of an ink pressure chamber outlet 60 and flows through an ink passage 62 to nozzle 54, from which ink drops are ejected.

Ink pressure chamber 58 is bounded on one side by a flexible diaphragm 64. The ink-jet actuator is a PMN:PT disk 66 (hereafter "disk 66") bonded to diaphragm 64 by an epoxy adhesive, a brazing compound, or preferably a eutectic metal alloy, such as a low-melting point solder. Disk 66 is positioned to overlay ink pressure chamber 58. In a conventional manner, disk 66 has metal film layers 68 to which an electronic drive circuit 70 is electrically connected. Although other forms of pressure transducers may be used, disc 66 is preferably operated in the transverse piezoelectric $d_{31}$ coefficient mode to produce a unimorph bending of diaphragm 64 and a corresponding volume change of pressure chamber 58 in response to a voltage across metal film layers 68.

To facilitate manufacture of the ink-jet print head of the present invention, body 10 is preferably formed of multiple laminated plates or sheets, such as of stainless steel. These sheets are stacked in a superimposed relationship and include a diaphragm plate 72 that forms one side of diaphragm 64; an ink pressure chamber plate 74 that defines ink pressure chamber 58 and a portion of ink inlet 56 and outlet 60; a separator plate 76 that bounds one side of ink pressure chamber 58 and defines ink inlet 56 and outlet 60; an ink supply channel plate 78 that defines ink supply channel 52 and a portion of ink passage 62; three more separator plates 80, 82, and 84 that define portions of passage 62 and bound one wall of ink supply channel 52; and a nozzle plate 86 that defines nozzle 54.

More or fewer plates than those shown and described may be used to define various ink flow passageways, manifolds, and pressure chambers of an ink-jet print head according to this invention. For example, multiple plates may be used to define an ink pressure chamber instead of the single plate illustrated in FIG. 4. Also, not all of the various features need be in separate sheets or layers of metal. For example, patterns in the photoresist that are used as templates for chemically etching the metal (if chemical etching is used in manufacturing) could be different on each side of a metal sheet. Thus, as a more specific example, the pattern for the ink inlet passage could be placed on one side of the metal sheet while the pattern for the pressure chamber could be placed on the other side and in registration front-to-back. Thus, with carefully controlled etching, separate ink inlet passage and pressure chamber containing layers could be combined into one common layer.

To minimize fabrication costs, all of the metal layers of the ink-jet print head, except nozzle plate 86, are designed so that they may be fabricated using relatively inexpensive conventional photo-patterning and etching processes in metal sheet stock, as well as stamping, punching or fine blanking. Machining or other metal working processes are not required. Nozzle plate 86 has been made successfully using any number of various processes, including electroforming from a sulfumate nickel bath, micro-electric discharge machining in 300 series stainless steel, and punching 300 series stainless steel, the last two approaches being used in concert with photo-patterning and etching all of the features of the nozzle plate except the nozzles themselves. Another suitable approach is to punch the nozzles and to use a standard blanking process to form the rest of the features in this plate. Other series stainless steel, such as 400 series, or even metal other than stainless steel could be used to fabricate the print head.

For this type of ink-jet actuator, a substantially circular shape has the highest electromechanical efficiency, which refers to the volume displacement for a given area of the PMN disk surface. Thus, actuators of this type are more efficient than rectangular type, bending mode transducers.

To provide an easily manufactured ink-jet array print head having high packing density, multiple ones of pressure chamber 58 are made generally planar to one another and are made much larger in transverse cross-sectional dimension than in depth. Such a configuration yields a higher pressure for a given displacement of disk 66 into the volume of pressure chambers 58. Moreover, all of ink-jet pressure chambers 58 are preferably, although not necessarily, located in the same plane within the ink-jet print head.

While disks 66 are ideally circular to conform to the circular shape of ink pressure chambers 58, little increase in drive voltage is required if disks 66 are made hexagonal. Therefore, disks 66 can be cut from a large slab of material using, for example, a saw. In the preferred hexagonal shape, disks 66 are typically about 0.15 millimeter thick and have a diameter of about 1.0 to about 3.0 millimeters. The diameter of the inscribed circle of the hexagonal shaped disks 66 is slightly less than the diameter of the associated pressure chamber 58. Diaphragm plate 72 is typically about 0.1 millimeter thick.

Figure 5:
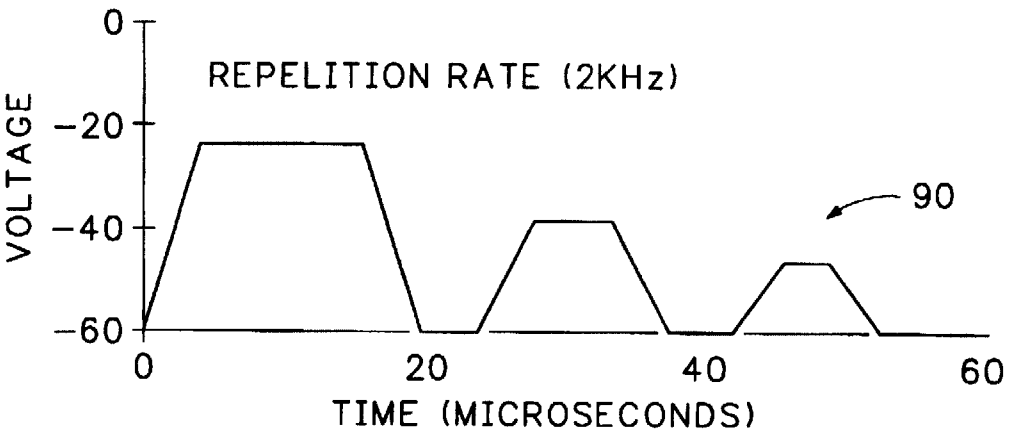
FIG. 5 is an electrical waveform diagram representing a PMN actuator drive waveform suitable for ejecting ink drops from the print head of FIG. 4.

FIG. 5 shows a representative actuator drive waveform 90 generated by drive circuit 70 that is suitable for ejecting a small drop of ink from ink-jet print head 50. Drive waveform 90 includes three pulses emanating from a −60 volt bias level that polarizes disk 66. The pulses have respective 15, 10, and 5 microsecond durations, 5 microsecond rise and fall times, and respective 36, 25, and 15 pulse amplitudes relative to the bias level. Drive waveform 90 is shaped to have a predetermined energy distribution that concentrates drop ejecting energy at a selected orifice resonant frequency while minimizing energy at resonant frequencies of ink-jet print head 50 internal features, such as ink supply channel 52, ink pressure chamber 58, and ink passage 62. Such a drive waveform provides ink drop ejection velocity uniformity at ink drop repetition rates exceeding 10,000 drops per second.

Many other drive waveforms may be shaped by skilled workers to meet particular printing application objectives. For example, a simpler waveform with a single pulse or a more complex waveform with bipolar or delayed pulses could be used. Drive waveform 90 is merely a representative one of many equivalent waveform shapes that can provide a desired energy distribution. For example, an equivalent of drive waveform 90 is a "mirror image" of drive waveform 90 in which the three pulses emanate in a negative direction from a +60 volt bias level. Of course, other bias voltage levels and polarities may be appropriately employed with their complementary drive waveforms. A particularly useful description of ink-jet actuator drive waveform design is found in co-pending U.S. patent application Ser. No. 08/100,504 filed Jul. 30, 1993 for METHOD AND APPARATUS FOR PRODUCING DOT SIZE MODULATED INK JET PRINTING, which is assigned to the assignee of this invention and incorporated herein by reference in pertinent part.

Just as many drive waveform shapes may be employed to meet particular printing objectives, so may many different drive circuits be employed to generate those waveforms. A typical circuit includes pulse timers driving complementary field-effect transistor ("FET") switches that are electrically connected to predetermined voltages to generate unipolar, bipolar, or multipulse waveforms. The pulses generated by such circuits have rise and fall times that are controlled by placing a series resistance between the FET switches and the actuator that has a characteristic capacitance.

A preferred drive circuit includes a waveform function generator driving the actuator through an analog feedback amplifier, such as an operational amplifier. Operational amplifiers are commercially available with plus and minus 18 volt output swings.

Skilled workers will recognize that there are various ways of applying a bias voltage to the actuator including offsetting the amplifier output voltage, applying a bias voltage to the undriven one of actuator metal film layers 68, or using an external biasing network.

Using PMN-based actuator materials in phase-change ink-jet print heads is particularly advantageous for improving ink drop ejection velocity uniformity over a range of temperatures. Most notably, the viscosity of phase-change ink decreases as temperature increases, causing jetting velocity to increase with temperature. Referring again to FIG. 3, the characteristic parameters of PMN material rise and fall around $T_M$, a fact that may be used advantageously. If the PMN actuator is operated at a temperature on the "back side" of the curve where the "d" coefficient decreases as the temperature increases, then an increase in ink drop ejection velocity caused by reduced viscosity is compensated for by a corresponding reduction in mechanical activity. The degree of compensation may not be exact, but the temperature range of substantially constant ink drop ejection velocity is significantly increased.

Figure 6:
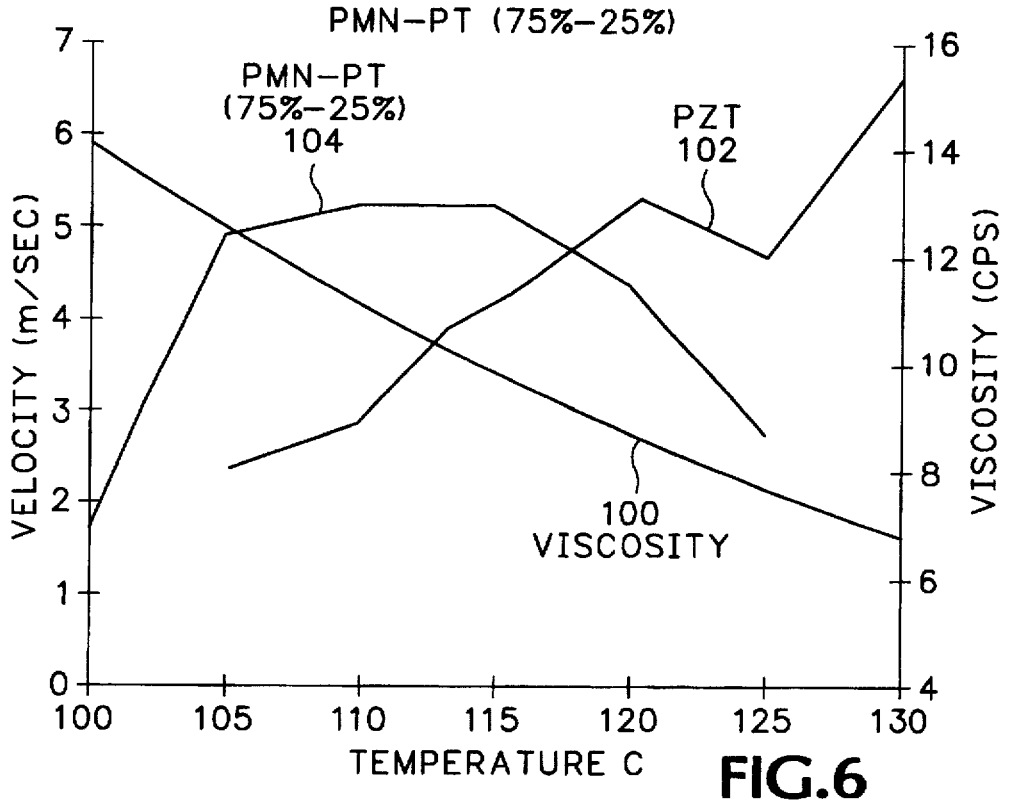
FIG. 6 is a graphical representation of phase-change ink viscosity and ink drop ejection velocity versus temperature for ink-jets driven respectively with PZT and PMN actuators.

FIG. 6 graphically shows results of an experimental comparison of the ink drop ejection velocity of two ink-jets having the same structural dimensions but different actuator materials. One of the ink-jets has a conventional PZT actuator and the other has an actuator including 75% PMN and 25% PT. A line 100 shows the phase-change ink viscosity change versus temperature. Skilled workers know that ink drop ejection velocity has a strong inverse relationship to ink viscosity. Line 102 shows this inverse relationship for the PZT actuator driven print head.

In sharp contrast, line 104 shows that ink drop ejection velocity remains substantially constant for the PMN:PT actuator driven print head over a temperature range from about 105° C. to about 120° C. This wide operating temperature range for PMN actuator driven ink-jet print heads has major advantages. For instance, the temperature uniformity of the head is not as critical, significantly easing print head thermal design, eliminating the need for heat spreading layers, and easing temperature variation concerns caused by moving printer components. Also, temperature sensors, temperature control devices, and associated circuits may be simplified. For example, positive temperature coefficient heaters having poor "set point" predictability may be employed.

Individual jets in an ink-jet array print head typically vary in ink drop ejection velocity from jet to jet because of small but unavoidable fabrication variations. To correct for these variations, a process referred to as normalization entails measuring the ejection velocity variations and adjusting the drive waveform presented to each individual actuator. The ink drop ejection velocity is usually reduced to some velocity slightly below the slowest velocity expected.

Normalization may be accomplished several ways. For example, U.S. Pat. No. 5,212,497 issued May 18, 1993 for INK JET VELOCITY NORMALIZATION, which is assigned to the assignee of this application, describes inserting a hybrid thick-film resistive voltage divider between the driver circuit and the actuator of each ink-jet. The drop ejection velocity of each ink-jet is measured and the associated voltage divider is laser trimmed to adjust the ejection velocity of each ink-jet to a predetermined value. Unfortunately, the adjustment is permanent.

A field adjustable normalization circuit employs a custom integrated driver circuit having an output voltage that is variable as a function of a digital input signal. As described above, the performance of the individual jets is measured. However, in this case, the measurements are used to encode a pattern into a read-only memory ("ROM") that provides a digital input signal to each ink-jet driver, thereby adjusting a bias voltage value driving each ink-jet actuator such that the drop ejection velocity of the nozzle array is uniform.

PMN actuators provide an opportunity to employ other normalization techniques, such as varying the bias voltage applied to each actuator to vary its "d" coefficient value. With such a technique, a single drive waveform is selectively applied to all the PMN actuators, and a bias voltage is separately and adjustably applied to each ink-jet actuator to adjust the drop ejection velocity of the associated ink-jet.

Figure 7:
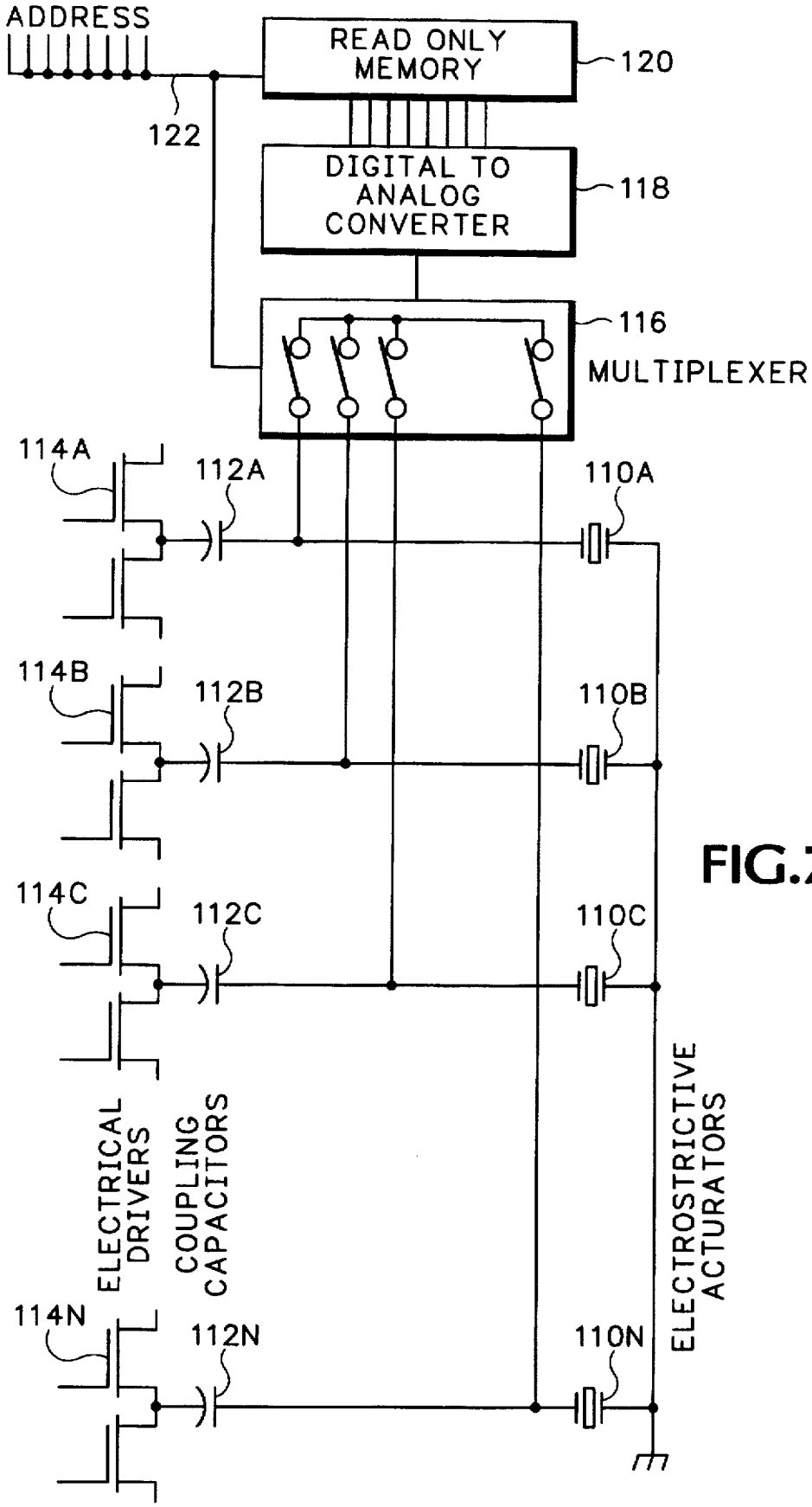
FIG. 7 is an electrical block diagram of an ink-jet array velocity normalization circuit.

FIG. 7 shows a preferred circuit for implementing the above-described bias voltage normalization technique. In an array type ink-jet print head, actuators 110A through 110N are electrically connected through coupling capacitors 112A through 112N to FET driver circuits 114A through 114N. The value of capacitors 112 is large relative to the characteristic capacitance of actuators 110. Actuators 110 are also connected to an analog multiplexer 116, the input of which is connected to a digital-to-analog converter ("DAC") 118 that receives bias voltage determining data from a ROM 120. An address bus 122 applies sequential address data simultaneously to ROM 120 and analog multiplexer 116 such that appropriate ones of capacitors 112 are charged to a bias voltage that DAC 118 converts from associated digital numbers stored in ROM 120. The sequential addressing repetition rate is sufficiently high to ensure that the bias voltage does not decay significantly between addressing cycles.

A preferred PMN-based material useful in this invention has a generalized chemical formula (1−x)PMN-xPT, or more particularly $(1-x)(Pb(Mg_{1/3}Nb_{2/3})O_3)\text{-}xPbTiO_3$, where x ranges from about 0.10 to about 0.35. The percentage composition of x depends entirely upon the desired operating temperature, which is a function of the ink employed. At the lower percentage composition of x, the desired operating temperature is in the ambient range, permitting the desired operating temperature to vary from about 25° C. to about 200° C. where moderate temperature changes affect the viscosity of the ink and therefore the performance of the ink-jet print head.

Another preferred PMN-based material useful in this invention has a generalized chemical formula (1−x)PMN-xPT-yLa, or more particularly $[Pb_{(1-1.5y)}La_y][(Mg_{1/3}Nb_{2/3})_{(1-x)}Ti_x]O_3$, where x ranges from about 0.10 to about 0.35 and y ranges from about 0.005 to about 0.02.

Figure 8:
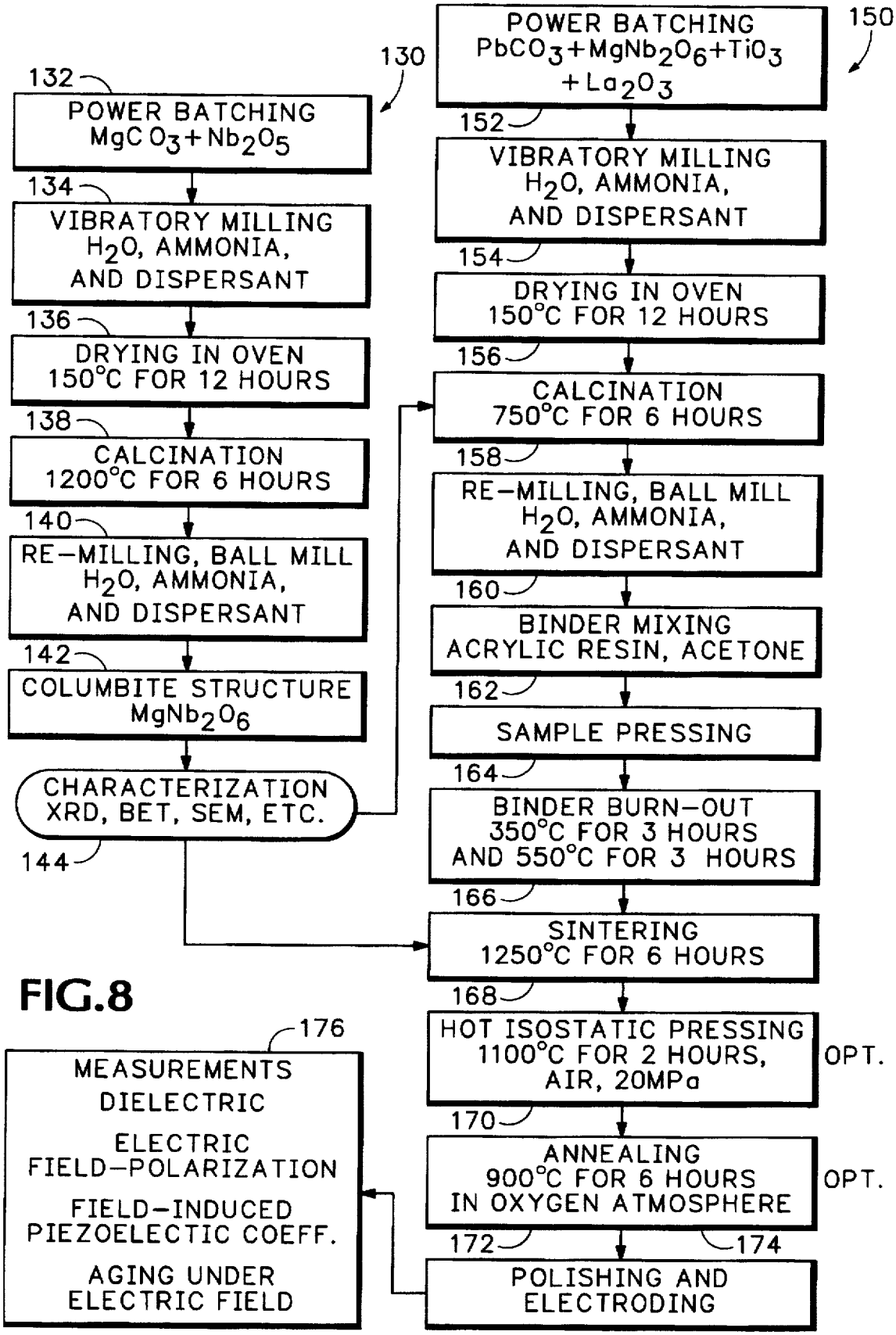
FIG. 8 is a flow diagram showing process steps employed to prepare PMN-based materials suitable for use in this invention.

The preferred PMN materials are prepared from reagent raw powders according to a process such as the one shown in FIG. 8.

A conventional B-site precursor (columbite) method 130 is employed to produce columbite phase $MgNb_2O_6$ which avoids parasitic pyrochlore phases.

In a powder batching process 132, $MgCO_3$ and $Nb_2O_3$ are mixed in a stoichiometric ratio. Proper dispersion is ensured by the addition of both a steric hindrance polyelethlyte dispersant and an electrostatic repulsion pH adjustment by ammonia.

The resulting 30% by volume slurry is subjected to a vibratory milling process 134.

In a drying process 136, the milled powder is dried in a 150° C. oven for twelve hours.

In a calcination process 138, the dried powder is calcined in an open alumina crucible at 1200° C. for six hours.

In a re-milling process 140, the calcined powder is ball milled.

In a hammermill process 142, the ball milled powder is pulverized to produce the precursor $MgNb_2O_6$ powder which is inspected by a characterization process 144 that may include processes, such as X-Ray diffraction ("XRD"), Brunauer Emmet Teller isotherm kinetic measurement ("BET"), and scanning electron microscope ("SEM") analysis.

Ink-jet actuators are made from the characterized precursor $MgNb_2O_6$ powder by a preferred actuator manufacturing process 150.

In a powder batching process 152, stoichiometric amounts of $PbCO_3$, $TiO_2$, and $La_2O_3$ are added to the precursor $MgNb_2O_6$ powder.

The resulting 30% by volume slurry is subjected to a vibratory milling process 154.

In a drying process 156, the milled powder is dried in a 150° C. oven for twelve hours.

In a calcination process 158, the dried powder is calcined in an open alumina crucible at 750° C. for six hours.

The calcined powder is inspected by characterization process 144.

In a re-milling process 160, the inspected calcined powder is ball milled to ensure proper mixing.

In a binder mixing process 162, the inspected calcined powder is mixed with a polymer binder such as an acryloid resin.

In a sample pressing process 164, the mixture of power and binder is uniaxially pressed at 10 to 30 MPa into 16 to 45 mm diameter pellets having a 2 to 5 mm thickness.

In a burn-out process 166, the pellets are heated to 350° C. for three hours and then to 550° C. for three hours to burn-out the binder material from the pellets, thereby yielding green ceramic samples.

In a sintering process 168, the green ceramic samples are placed on platinum foil in closed alumina crucibles and sintered at 1250° C. for six hours. A PbO-rich atmosphere is maintained in the closed crucibles by placing a small amount of equimolar PbO and $ZrO_2$ powder mixture in a small alumina boat and sealing the crucible closed with alumina cement. A crucible heating rate of 4° C./minute is used to help prevent PbO loss.

The sintered ceramic samples are inspected by characterization process 144.

In an optional pressing process 170, the sintered ceramic samples are hot-isostatic pressed at a temperature about 100°–200° C. below the sintering temperature to eliminate closed-porosities and high-impedance PbO-rich grain boundary phases. Ceramic samples having 98% theoretical density are produced by 20 MPa hot-isostatic pressing at about 1100° C. for two hours in an air atmosphere.

In an optional annealing process 172, the pressed ceramic samples are placed in an open alumina crucible and annealed in an oxygen atmosphere at 900° C. for six hours and then cooled to room temperature in twelve hours. Annealing process 172 compensates oxygen vacancies formed during sintering process 168 and pressing process 170 and removes PbO-rich phases from grain boundaries.

In a polishing and electroding process 174, the annealed ceramic samples are sized and polished and then plated with an electrically conductive material to produce finished actuators that are ready for bonding to an ink-jet diaphragm.

In a measurement process 176, the finished actuators are measured at various temperatures to characterize their dielectric constant, polarization, "d" coefficient, and electric field aging parameters. Parameter characterizations for the PMN-based actuators are described below with reference to FIGS. 9–12 and Table 1.

Figure 9:
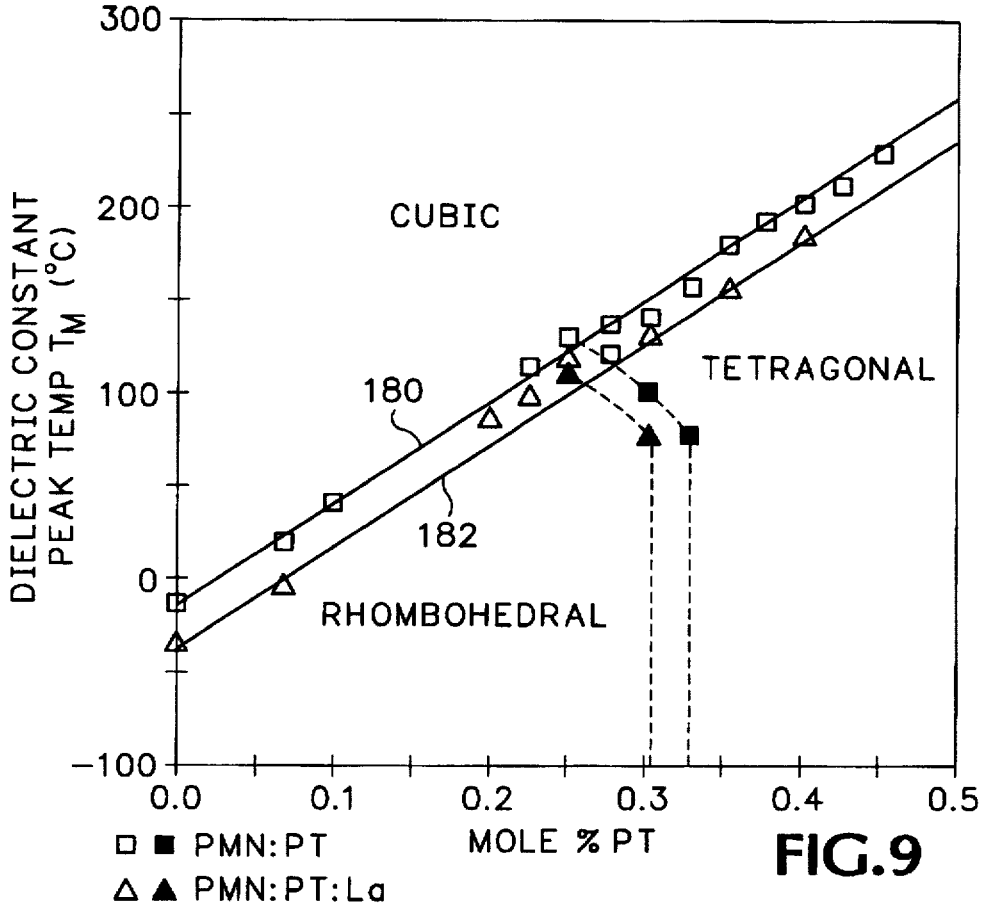
FIG. 9 is a graphical representation showing the dielectric constant peak temperature TM change in a PMN material of this invention as a function of PT concentration with and without 1-mole % Lanthanum ("La") doping.

FIG. 9 graphically shows the dielectric constant peak temperature $T_M$ change as a function of PT concentration with and without La doping. A line 180 indicates the change in $T_M$ for PMN:PT materials and a line 182 shows the change in $T_M$ for PMN:PT:La(1%) materials. $T_M$ changes about 5.5° C./% of PT concentration change and about 22° C./% of La concentration change.

Figure 10:
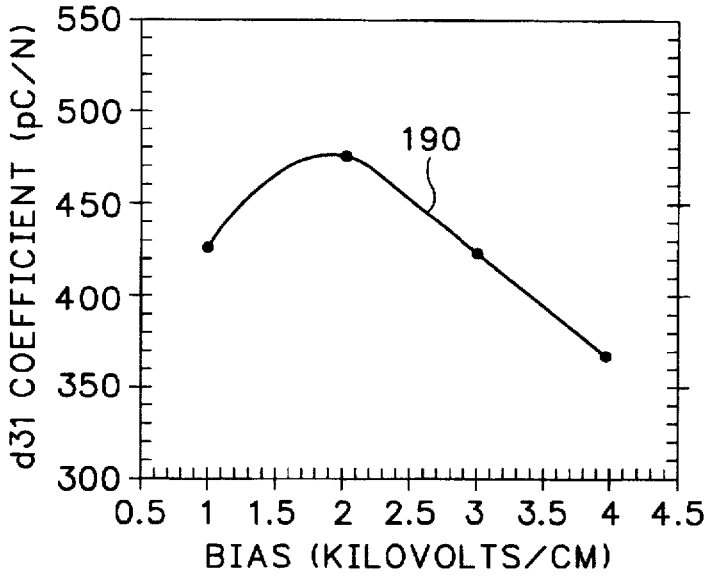
FIG. 10 is a graphical representation showing the change in $d_{31}$ coefficient value as a function of bias voltage at a fixed temperature for a preferred PMN material composition of this invention.
Figure 11:
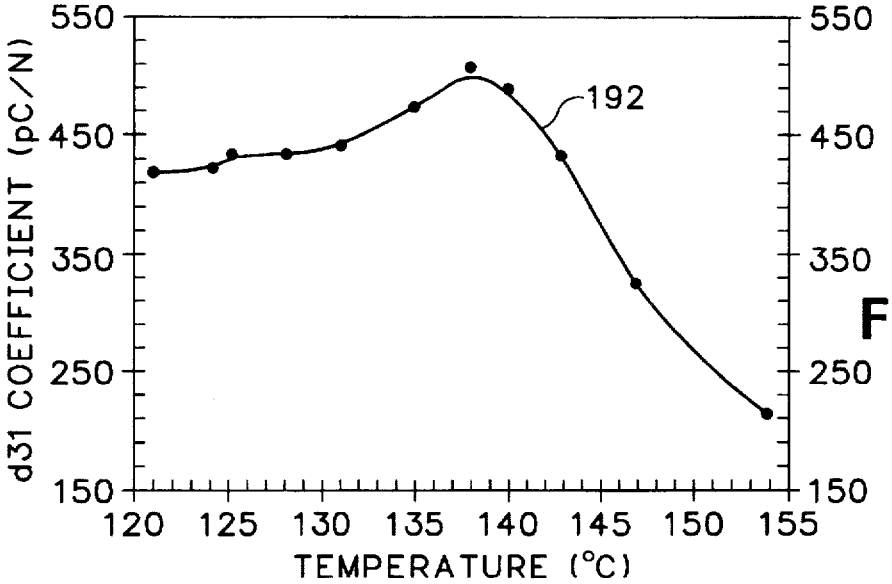
FIG. 11 is a graphical representation showing the change in $d_{31}$ coefficient value as a function of temperature for a preferred PMN material composition of this invention.
Figure 12:
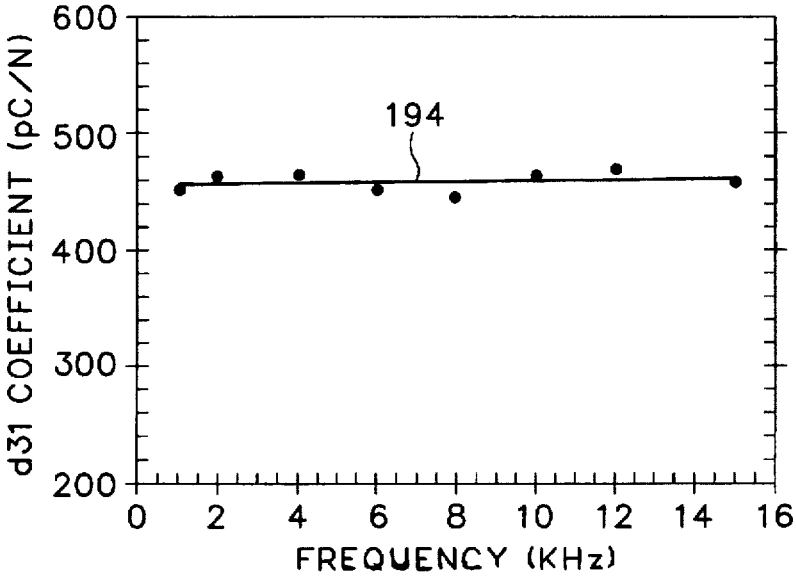
FIG. 12 is a graphical representation showing the change in $d_{31}$ coefficient value as a function of operating frequency for a preferred PMN material composition of this invention.

The piezoelectric $d_{31}$ coefficient value represents the degree of mechanical activity available from an actuator material. It is, therefore, important to measure several parameters influencing the $d_{31}$ coefficient value. FIGS. 10–12 show parameter measurements for a preferred PMN:PT (70%/30%) actuator material formulated for use in a phase-change ink-jet print head. Unless otherwise varied, measurements were made with an actuator temperature of about 135° C., an ink drop ejection repetition rate of about 10 KHz, and an actuator bias of about 2,000 volts/centimeter. Where a lower actuator temperature is to be employed, such as at ambient temperatures, a print head other than a phase change ink-jet print head would be employed and the PMN:PT actuator material ratio would be formulated for use at about a (90%/10%) ratio.

In FIG. 10, a line 190 shows how the $d_{31}$ coefficient value changes as a function of an applied electric bias field strength. The $d_{31}$ coefficient value peaks at about 2,000 volts/centimeter. Because the actuators have a thickness of about 0.15 millimeter, a bias voltage of only 11.8 volts is required to achieve the peak bias field strength.

In FIG. 11, a line 192 shows how the $d_{31}$ coefficient value changes as a function of actuator temperature. The $d_{31}$ coefficient value peaks at about 138° C. and decreases substantially linearly with temperatures above the temperature of the peak.

In FIG. 12, a line 194 shows how the $d_{31}$ coefficient value changes as a function of actuator operating frequency. The $d_{31}$ coefficient value is substantially constant for frequencies in a range from about 1 KHz to about 15 KHz.

Table 1 lists typical data for several properties of suitable $[Pb_{1-1.5y}La_y][Mg_{1/3}Nb_{2/3}]_{1-x}Ti_xO_3$ material compositions at 1 KHz.

TABLE 1

| x | y | $T_m$ (°C.) | $K_m$ | $T_m$ (2kV/cm bias) | $K_m$ (2kV/cm bias) | $d_{33}$ (pC/N) |
|---|---|---|---|---|---|---|
| 0.28 | 0.00 | 138 | 32,000 | 140 | 30,000 | 330 |
| 0.30 | 0.01 | 119 | 25,000 | 119 | 25,000 | 635 |
| 0.32 | 0.01 | 129 | 24,500 | 129 | 24,000 | 680 |

Material compositions made according to the process of FIG. 8 should have repeatable parameters from batch-to-batch. The maximum allowable variation for $T_M$ is 5° C., for peak dielectric constant value is 10%, and for peak dielectric loss is 0.05.

The room temperature $d_{33}$ coefficient (at 100 Hz, poled at 30,000 volts/centimeter at 70° C. for 5 minutes), for each composition should not vary from batch to batch by more than 10%.

A mean grain size for the PMN compositions should be about 3–4 microns for materials without La and about 1–2 microns for materials with La.

Skilled workers will recognize that portions of this invention may have alternative embodiments. For example, the actuator materials described may be used in single or array-type ink-jet print heads of various configurations for ejecting aqueous inks, phase-change inks, or fluids of various compositions.

PMN-based materials are described, but other materials of this class exist and may be employed in this invention, such as lead lanthanum zirconium titanate $[Pb_{1-x}La_x(Zr_yTi_z)_{1-x/4}—O_3]$, lead scandium tantalate, and lead zinc niobate.

Although a unimorph actuator structure is described above, the advantages of electrostrictive materials are independent of the actuator geometry and operating mode employed and would, therefore, also apply to multilayer and composite actuator structures.

Alternatively, circular or other shaped PMN actuators may be screen printed directly on diaphragm 64. In a conventional thick-film process, the PMN-based material is roller milled together with glass additives to form a fine slurry of nitrogen fireable paste. The paste is collected from the roller mill with a sharp blade and deposited on a silk screen. The screen is preferably about 100 microns thick and includes a suitable actuator pattern. The screen is placed over a suitable metal or ceramic substrate, such as a stainless steel diaphragm and a Teflon squeegee distributes the paste across the screen to print the actuator pattern on the substrate. Individual actuators as small as 1.0 millimeter in diameter and 100 micron thick may be printed. Alternatively, a large area (i.e., a 2.54 centimeter diameter circle) of actuator material may be printed for subsequent kerfing into a desired actuator pattern. The printed substrate is co-fired in a moving belt kiln at about 950° C. in a Nitrogen atmosphere. Electrodes may be deposited on the actuators using conventional thick-film processes.

Because PMN material undergoes a relatively large change in dielectric constant and dielectric loss as the temperature changes, a temperature control circuit can be embodied in which PMN is the dielectric material of a capacitive temperature-sensing element. Therefore, ink-jet PMN actuators may also be used as signal sensors for measuring parameters such as pressure chamber temperature, pressure, resonance, and bubble presence.

It will be obvious to those having skill in the art that many changes may be made to the details of the above-described embodiments of this invention without departing from the underlying principles thereof. Accordingly, it will be appreciated that this invention is also applicable to electrostrictive actuator applications other than those found in ink-jet printers. The scope of the present invention should, therefore, be determined only by the following claims.

We claim:

1. A method of providing normalized ink drop ejection velocities from at least first and second nozzles in an array of nozzles in an ink jet print head, the first and second nozzles being driven respectively by first and second actuators, comprising the steps of:

making the first and second actuators from a ferroelectric relaxer ceramic material that provides the first and second actuators with a degree of mechanical activity that changes as a function of an applied bias voltage and temperature, the ferroelectric relaxor ceramic material having a maximum degree of the mechanical activity at a temperature Tmax of greater than 100° C.;

operating the ink jet print head at a temperature greater than Tmax:

applying first and second bias voltages respectively to the first and second actuators;

driving the first and second actuators with substantially identical first and second electrical waveforms; and adjusting the first and second bias voltages to adjust the degree of mechanical activity of the first and second actuators in response to the substantially identical first and second electrical waveforms to eject from the first and second nozzles respective first and second ink drops having the normalized ink drop ejection velocities.

2. The method of claim 1 in which the substantially identical first and second electrical waveforms each have a peak-to-peak voltage amplitude and the method further includes setting the peak-to-peak voltage amplitude to less than about 36 volts.

3. The method of claim 1 in which the adjusting step further comprises:

storing first and second digital numbers representing respectively the first and second bias voltages; and converting the first and second digital numbers to the first and second bias voltages.

4. The method of claim 3 in which the storing step includes:

setting the first and second bias voltages to a substantially equal value;

driving the first and second actuators with the substantially identical first and second electrical waveforms;

measuring an unnormalized ink drop ejection velocity of the first and second nozzles; and determining the first and second digital numbers required to eject from the first and second nozzles the first and second ink drops having the normalized ink drop ejection velocities.

5. The method of claim 3 further including connecting the first and second actuators to respective first and second capacitors and periodically storing the first and second bias voltages in the first and second capacitors, and in which the driving step includes coupling the substantially identical first and second electrical waveforms respectively through the first and second capacitors.

6. In an ink-jet print head having an array of nozzles and an apparatus for normalizing an ink drop ejection velocity from each nozzle of the array, an improved normalizing apparatus comprising:

a ferroelectric relaxor ceramic actuator associated with each nozzle, each actuator exhibiting a degree of mechanical activity that changes as a function of a bias voltage and a temperature applied to the actuator, the ferroelectric relaxor ceramic actuator having a maximum degree of the mechanical activity at a temperature (Tmax) of greater than 100° C., the ink jet print head operating at a temperature greater than Tmax;

a drive circuit that generates an electrical waveform and drives each actuator with a substantially identical electrical waveform; and a bias voltage adjusting circuit for adjusting the bias voltage applied to each actuator and thereby changing the degree of mechanical activity of each actuator to eject an ink drop from each nozzle of the array at a normalized ink drop ejection velocity in response to each actuator receiving the substantially identical electrical waveform.

7. The apparatus of claim 6 in which the bias voltage adjusting circuit further comprises a memory storing a set of digital numbers, each of which represents an adjusted bias voltage required to normalize the ejection velocity of an associated nozzle and a digital-to-analog converter converting the digital numbers to the adjusted bias voltages.

8. The apparatus of claim 7 in which the adjusted bias voltages are periodically distributed to a set of capacitors that are each associated with an actuator and store the adjusted bias voltages for the actuators, and in which the electrical waveform is coupled through the set of capacitors to the actuators.

9. The apparatus of claim 6 in which the electrical waveform has a peak-to-peak voltage amplitude less than about 36 volts.

* * * * *